US008899644B2

(12) United States Patent
Hancey

(10) Patent No.: US 8,899,644 B2
(45) Date of Patent: Dec. 2, 2014

(54) HOLDER FOR A BEVERAGE CONTAINER

(71) Applicant: Nicholas S. Hancey, Centerville, UT (US)

(72) Inventor: Nicholas S. Hancey, Centerville, UT (US)

( * ) Notice: Subject to any disclaimer, the term of this patent is extended or adjusted under 35 U.S.C. 154(b) by 0 days.

(21) Appl. No.: 14/159,713

(22) Filed: Jan. 21, 2014

(65) Prior Publication Data

US 2014/0239656 A1 Aug. 28, 2014

Related U.S. Application Data

(63) Continuation-in-part of application No. 29/446,341, filed on Feb. 22, 2013.

(51) Int. Cl.
*B65D 23/10* (2006.01)
*A45F 5/10* (2006.01)

(52) U.S. Cl.
CPC ..... *A45F 5/10* (2013.01)
USPC ..... 294/31.2; 294/148; 294/157; 215/396

(58) Field of Classification Search
USPC ..... 294/31.2, 33, 137, 148, 149, 154, 157, 294/165, 166, 170; 215/396
See application file for complete search history.

(56) References Cited

U.S. PATENT DOCUMENTS

| | | | | |
|---|---|---|---|---|
| 1,486,967 | A | | 3/1924 | Kaufman |
| 1,825,897 | A | | 10/1931 | Brooke |
| 2,029,051 | A | | 1/1936 | Blevins |
| 2,075,217 | A | | 3/1937 | Milburn |
| 2,101,526 | A | | 12/1937 | Bryant |
| D149,933 | S | | 6/1948 | Bushman |
| 2,524,639 | A | | 10/1950 | Saunders |
| 2,617,676 | A | * | 11/1952 | Kinney, Jr. ..... 294/31.2 |
| D171,255 | S | | 1/1954 | Holbrook |
| 2,812,968 | A | * | 11/1957 | Sevener ..... 294/33 |
| 2,838,202 | A | | 6/1958 | Heuther |
| 2,922,558 | A | * | 1/1960 | Harvey ..... 294/148 |
| 2,981,562 | A | | 4/1961 | Long |
| 3,116,947 | A | * | 1/1964 | Brownrigg ..... 294/31.2 |
| D209,533 | S | | 12/1967 | Cole |
| 3,462,536 | A | | 8/1969 | Updegraff et al. |
| 3,520,570 | A | | 7/1970 | Christopher et al. |
| 3,612,595 | A | | 10/1971 | Updegraff et al. |
| 3,653,610 | A | | 4/1972 | Owen |
| 3,682,352 | A | * | 8/1972 | Doucette ..... 220/754 |
| 3,794,370 | A | | 2/1974 | Lockhart et al. |
| 3,979,011 | A | | 9/1976 | Schleicher |
| D256,418 | S | | 8/1980 | Corbett |
| D265,880 | S | | 8/1982 | Craig |
| 4,363,415 | A | | 12/1982 | Rainville |
| 4,379,578 | A | | 4/1983 | Schuler |
| D287,451 | S | | 12/1986 | Schrock |

(Continued)

*Primary Examiner* — Dean Kramer
(74) *Attorney, Agent, or Firm* — Martin & Associates, LLC; Derek P. Martin

(57) ABSTRACT

A holder for a beverage container includes first and second loops that are each coupled to opposing ends of a handle. The first and second loops are sized to be smaller than a target beverage container. The holder is attached to a the target beverage container by stretching the first loop and placing the first loop around one end of the beverage container, then stretching the second loop and placing the second loop around the opposite end of the beverage container. The holder can then be used to easily transport the beverage container, or to attach the beverage container to something, such as a bicycle or backpack. The holder is made of a rugged and durable material that allows repeated use of the handle over many years.

1 Claim, 5 Drawing Sheets

(56) References Cited

U.S. PATENT DOCUMENTS

| | | | | | |
|---|---|---|---|---|---|
| 4,627,546 | A | * | 12/1986 | Carranza | 215/396 |
| 4,724,971 | A | * | 2/1988 | Henline | 215/396 |
| 4,727,997 | A | | 3/1988 | Nakamura et al. | |
| 4,984,724 | A | * | 1/1991 | Johnston | 224/257 |
| D323,430 | S | | 1/1992 | Niederkorn | |
| 5,167,354 | A | | 12/1992 | Cohanfard | |
| D334,142 | S | | 3/1993 | Gagnon | |
| 5,203,481 | A | | 4/1993 | Dobbins et al. | |
| D336,827 | S | | 6/1993 | Knight | |
| D357,387 | S | | 4/1995 | Davidson et al. | |
| 5,413,231 | A | | 5/1995 | Carroll et al. | |
| 5,413,261 | A | | 5/1995 | Wu | |
| D373,240 | S | | 9/1996 | Parnell | |
| 5,622,346 | A | * | 4/1997 | Story, Jr. | 248/311.2 |
| D395,238 | S | | 6/1998 | Freitas | |
| D395,825 | S | | 7/1998 | Freitas | |
| D458,846 | S | | 6/2002 | Writt, Sr. | |
| D489,263 | S | | 5/2004 | Sinanian | |
| D512,272 | S | | 12/2005 | Avrish | |
| D512,275 | S | | 12/2005 | Kent-Fawkes | |
| D522,243 | S | | 6/2006 | Brown, Sr. | |
| 7,458,921 | B2 | * | 12/2008 | Hallar | 482/106 |
| 7,520,412 | B2 | | 4/2009 | Willows et al. | |
| D615,366 | S | | 5/2010 | Berezansky | |
| 8,152,011 | B2 | | 4/2012 | Willows et al. | |
| D681,326 | S | | 5/2013 | Willows et al. | |
| D682,545 | S | | 5/2013 | Willows et al. | |
| D687,222 | S | | 8/2013 | Willows et al. | |
| 8,561,834 | B2 | * | 10/2013 | Ziegler | 220/740 |
| 2003/0234236 | A1 | | 12/2003 | Michalowski | |
| 2004/0135049 | A1 | | 7/2004 | Kent-Fawkes | |
| 2005/0046210 | A1 | | 3/2005 | Ward et al. | |
| 2005/0109725 | A1 | | 5/2005 | Stewart et al. | |
| 2008/0061025 | A1 | | 3/2008 | Egnatski | |
| 2008/0264896 | A1 | * | 10/2008 | Eveleth | 215/396 |

* cited by examiner

HOLDER FOR A BEVERAGE CONTAINER

BACKGROUND

1. Technical Field

This disclosure generally relates to beverage containers, and more specifically relates to a holder for a beverage container.

2. Background Art

Many different kinds, sizes and types of beverage containers have been developed over the years. Sports bottles have been developed that allow a person easy access to a beverage while playing a sport. For example, sports bottles with holders have been developed for bicycles that allow mounting the holder on the bicycle and placing a sports bottle in the holder, making the sports bottle available to the rider while the rider is riding the bicycle. Many different types of sports bottles and holders have been developed.

Disposable water bottles have become very popular. Because hydration during a lengthy sporting activity is desirable, various holders for water bottles have been developed. For example, fabric holders for water bottles that can be worn on a belt or strap are well-known. These fabric holders typically have a closure, such as a zipper, snap, or hook-and-loop fastener, that, when opened, allows a water bottle to be placed within the holder, and when closed, retain the water bottle in place. When a person wants to take a drink, the person opens the closure, removes the water bottle, takes a drink, returns the water bottle to the holder, then closes the closure.

Other beverage bottles have been developed that are intended for repeated use. For example, rigid plastic bottles are often used by backpackers, who repeatedly refill the bottle from a hand-operated water filter when the backpacker encounters a suitable water source such as a stream or lake.

Most beverage bottles are hand-held, which necessarily occupies one or both hands to carry the beverage bottle. For most beverage bottles, including disposable water bottles, there are few holders that provide the desired flexibility and convenience.

BRIEF SUMMARY

A holder for a beverage container includes first and second loops that are each coupled to opposing ends of a handle. The first and second loops are sized to be smaller than a target beverage container. The holder is attached to a the target beverage container by stretching the first loop and placing the first loop around one end of the beverage container, then stretching the second loop and placing the second loop around the opposite end of the beverage container. The holder can then be used to easily transport the beverage container, or to attach the beverage container to something, such as a bicycle or backpack. The holder is made of a rugged and durable material that allows repeated use of the handle over many years.

The foregoing and other features and advantages will be apparent from the following more particular description, as illustrated in the accompanying drawings.

BRIEF DESCRIPTION OF THE SEVERAL VIEWS OF THE DRAWING(S)

The disclosure will be described in conjunction with the appended drawings, where like designations denote like elements, and:

DETAILED DESCRIPTION

A holder for a beverage container includes first and second loops that are each coupled to opposing ends of a handle. The first and second loops are sized to be smaller than a target beverage container. The holder is attached to a the target beverage container by stretching the first loop and placing the first loop around one end of the beverage container, then stretching the second loop and placing the second loop around the opposite end of the beverage container. The holder can then be used to easily transport the beverage container, or to attach the beverage container to something, such as a bicycle or backpack. The holder is made of a rugged and durable resilient material that allows repeated use of the handle over many years.

Figure 1:
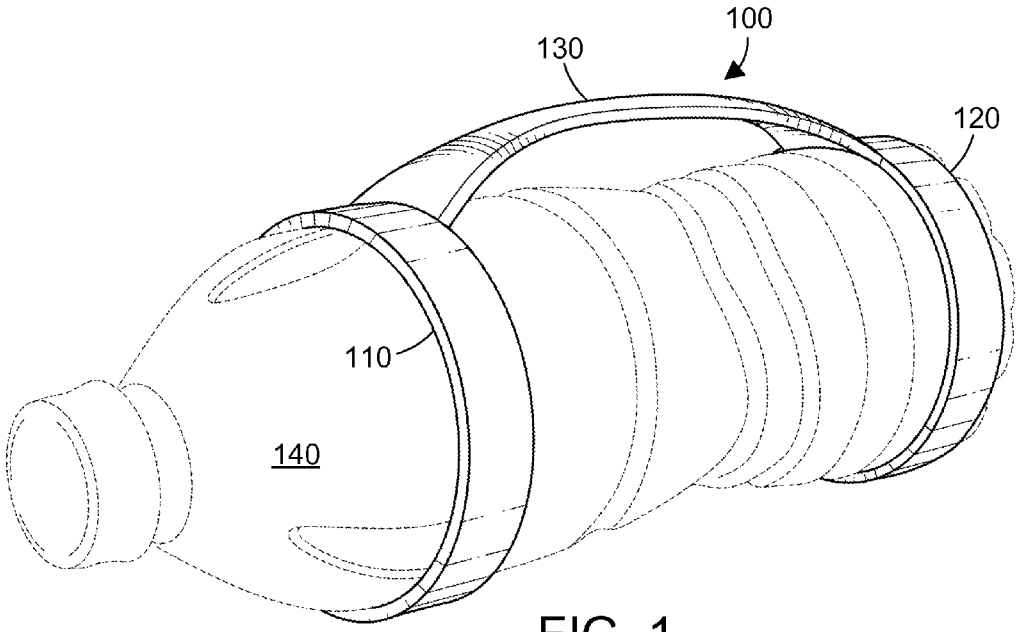
FIG. 1 is perspective view of a holder for a beverage container shown placed on a disposable water bottle.
Figure 2:
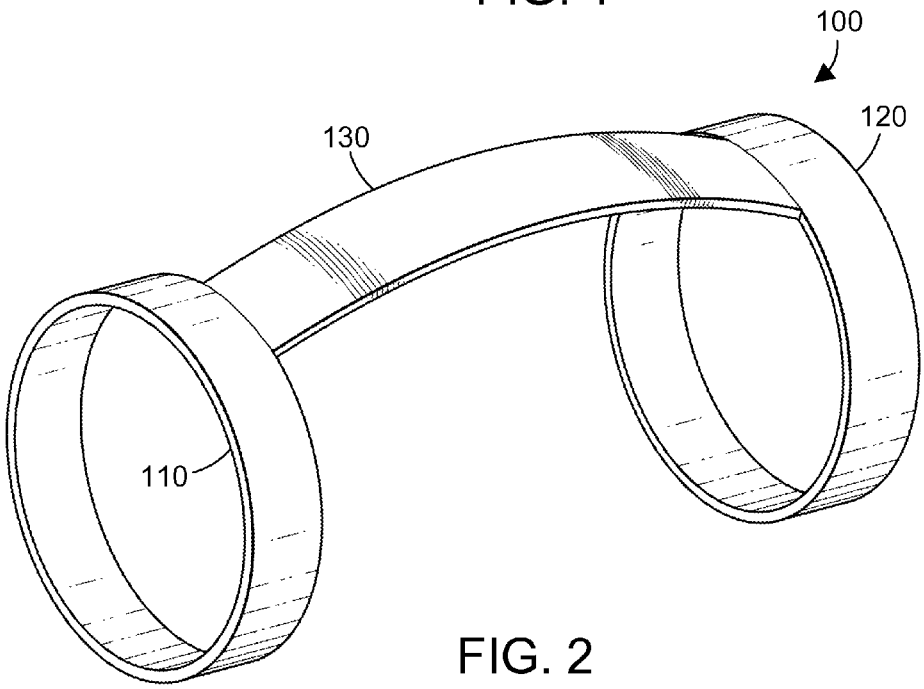
FIG. 2 is a perspective view of the holder for a beverage container shown in FIG. 1.

Referring to FIGS. 1-7, a holder 100 comprises a first loop 110, a second loop 120, and a handle 130 that has opposing ends connected to the first loop 110 and the second loop 120. The holder 100 is shown in FIG. 1 on a disposable water bottle 140 (shown in phantom in FIG. 1) for the purpose of illustration. In the most preferred implementation, the diameter D1 of the first loop 110 (FIG. 6) is the same as the diameter D2 of the second loop 130 (FIG. 7), and is smaller than the diameter of a target beverage container, such as the water bottle 140 shown in FIG. 1. The holder 100 is placed on the disposable water bottle by stretching the first loop 110 over one end of the water bottle 140, then stretching the second loop 120 over the opposite end of the water bottle 140, with the result as shown in FIG. 1.

The holder 100 is preferably made from a resilient material that allows the loops to stretch to be place on a beverage container. Any suitable resilient material could be used, whether naturally-occurring, man-made, or some combination of naturally-occurring and man-made materials, and whether currently known or developed in the future. One specific example of a suitable resilient material is silicone rubber, which can be injected into an injection mold then cured. Of course, silicone rubber could be mixed with any other suitable materials or admixtures to produce a holder 100 with the desired characteristics. In addition, various plastics and other resilient materials could be used.

The loops 110 and 120 are preferably continuous loops with no breaks. However, in an alternative implementation, the loops could be discontinuous with ends connected by a suitable fastener such as a snap, hook-and-loop fastener, etc.

Figure 3:
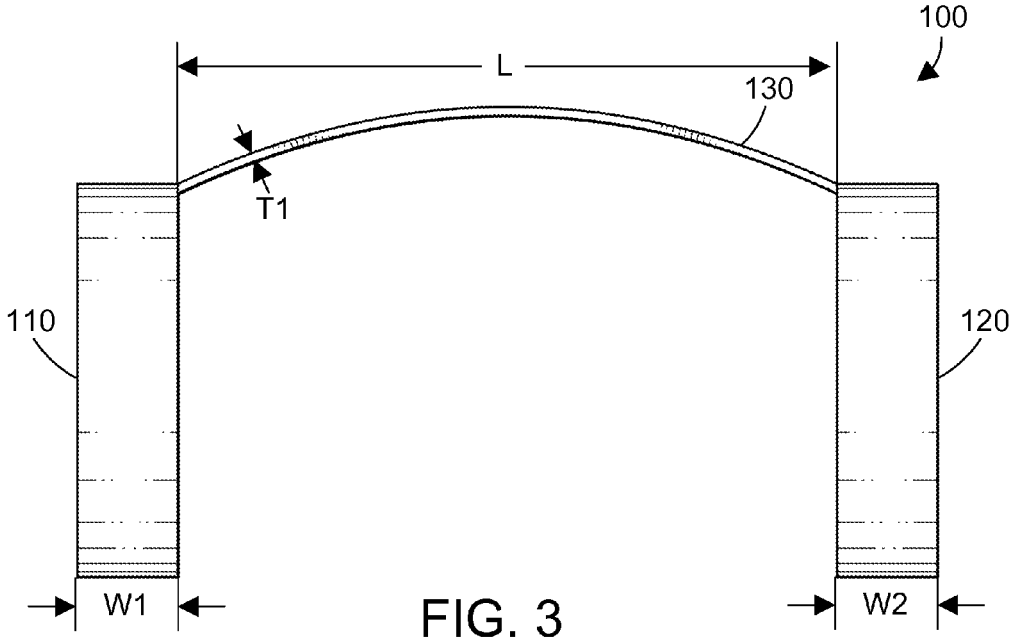
FIG. 3 is a side view of the holder for a beverage container.
Figure 4:
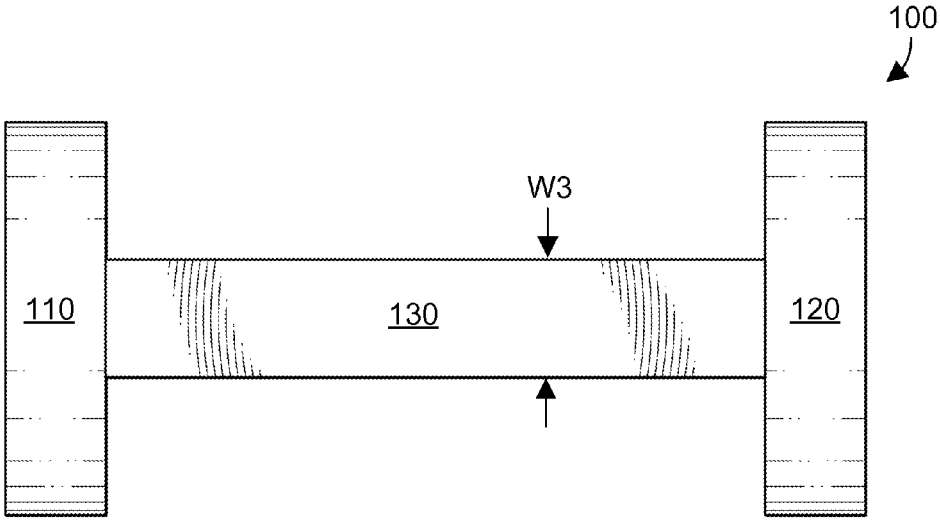
FIG. 4 is a top view of the holder for a beverage container.
Figure 5:
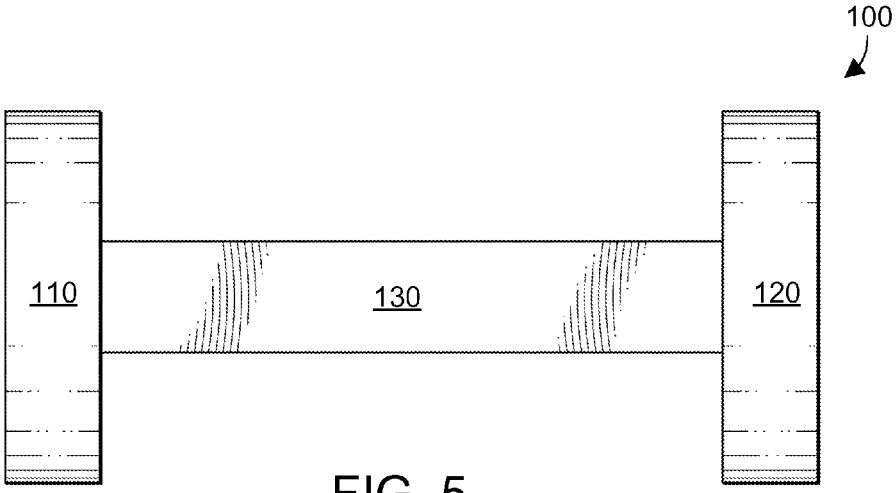
FIG. 5 is a bottom view of the holder for a beverage container.
Figure 6:
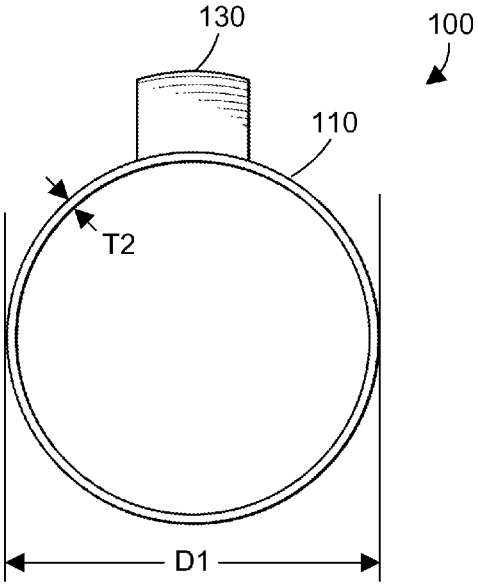
FIG. 6 is a first end view of the holder for a beverage container.
Figure 7:
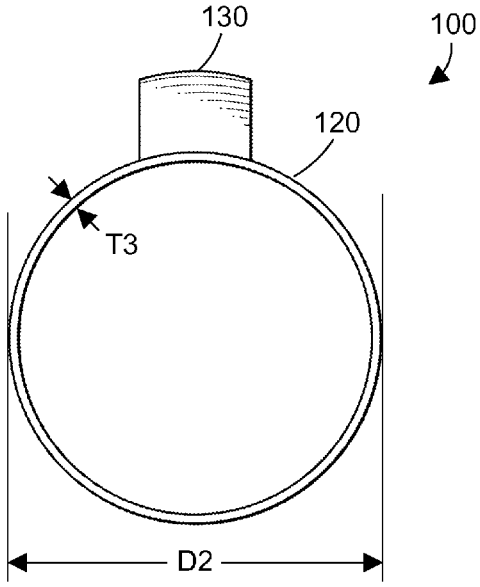
FIG. 7 is a second end view of the holder for a beverage container.

The dimensions for holder 100 may vary as needed to accommodate a wide range of different shapes and sizes of beverage containers. For use with disposable water bottles as shown in FIG. 1, the thickness T1 of the handle shown in FIG. 3 is in the range of 1-5 millimeters, is more preferably in the range of 1.5-2.5 millimeters, and is most preferably approximately 2 millimeters. Similarly, the thickness T2 of the first loop 110 (FIG. 6) and the thickness T3 of the second loop 120 (FIG. 7) are also in the range of 1-5 millimeters, are more preferably in the range of 1.5-2.5 millimeters, and are most preferably approximately 2 millimeters. Of course, these thicknesses T1, T2 and T3 need not be the same, and could be different from each other.

The loops 110 and 120 can have the same size diameter, or can be different diameters. When used on a disposable water bottle as shown in FIG. 1, the diameter D1 of loop 110 (FIG. 6) and the diameter D2 of loop 120 (FIG. 7) are preferably the same size. In one specific implementation, the diameter D1 of loop 110 is in the range of 20-100 millimeters, is more preferably in the range of 60-80 millimeters, and is most preferably approximately 70 millimeters. In similar fashion, the diameter D2 of loop 120 is in the range of 20-100 millimeters, is more preferably in the range of 60-80 millimeters, and is most preferably approximately 70 millimeters. Of course, the diameters of the loops 110 and 120 can vary to accommodate a wide range of sizes of beverage containers.

The width of the loops 110 and 120 can be the same, or can be different. In one specific implementation, the width W1 of loop 110 (FIG. 3) is in the range of 4-30 millimeters, is more preferably in the range of 12-16 millimeters, and is most preferably approximately 14 millimeters. Similarly, the width W2 of loop 120 (FIG. 3) is in the range of 4-30 millimeters, is more preferably in the range of 12-16 millimeters, and is most preferably approximately 14 millimeters.

The width of handle 130 can vary as needed depending on the size and shape of the beverage container being held by the holder 100. In one specific implementation, the width W3 of handle 130 (FIG. 4) is in the range of 5-40 millimeters, is more preferably in the range of 20-28 millimeters, and is most preferably approximately 24 millimeters. The length L of handle 130 (FIG. 3) can vary. In one specific implementation, the length L of handle 130 (FIG. 3) is in the range of 80-300 millimeters, is more preferably in the range of 100-130 millimeters, and is most preferably approximately 114 millimeters. These dimensions provide a handle that is easy for a person to hold in one hand. Of course, the length of the handle 130 can vary to accommodate a wide range of sizes of beverage containers.

Figure 8:
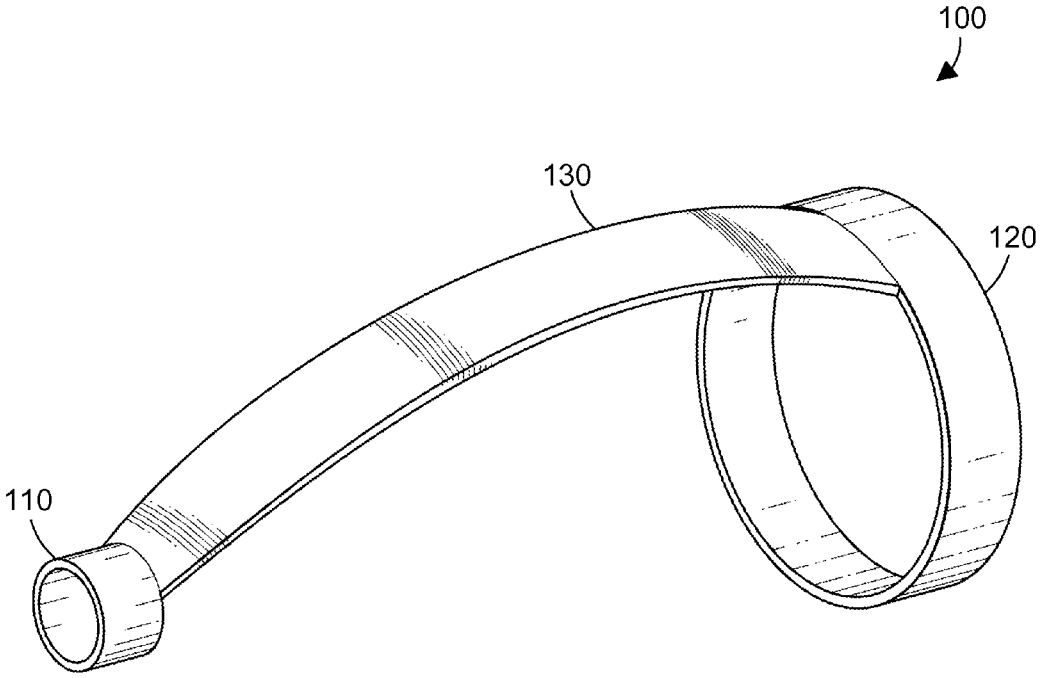
FIG. 8 is a perspective view of an alternative configuration for the holder for a beverage container.

While FIGS. 1-7 show loops 110 and 120 that are approximately the same size, the holder 100 may include loops 110 and 120 that are different sizes (i.e., have different diameters). One such example is shown in FIG. 8, where loop 110 has a diameter substantially smaller than the diameter of loop 120. This configuration could be used, for example, on a two-liter bottle, where the second loop 120 is placed around the bottom of the two-liter bottle while the first loop 110 is placed around the neck of the two liter bottle. FIG. 8 is shown to generally represent that loops 110 and 120 can be any suitable size according to the needed application.

The disclosure and drawings thus support an article of manufacture comprising a first loop formed of a resilient material having a first diameter; a second loop formed of the resilient material having a second diameter; and a handle having a first end coupled to the first loop and a second end coupled to the second loop.

Figure 9:
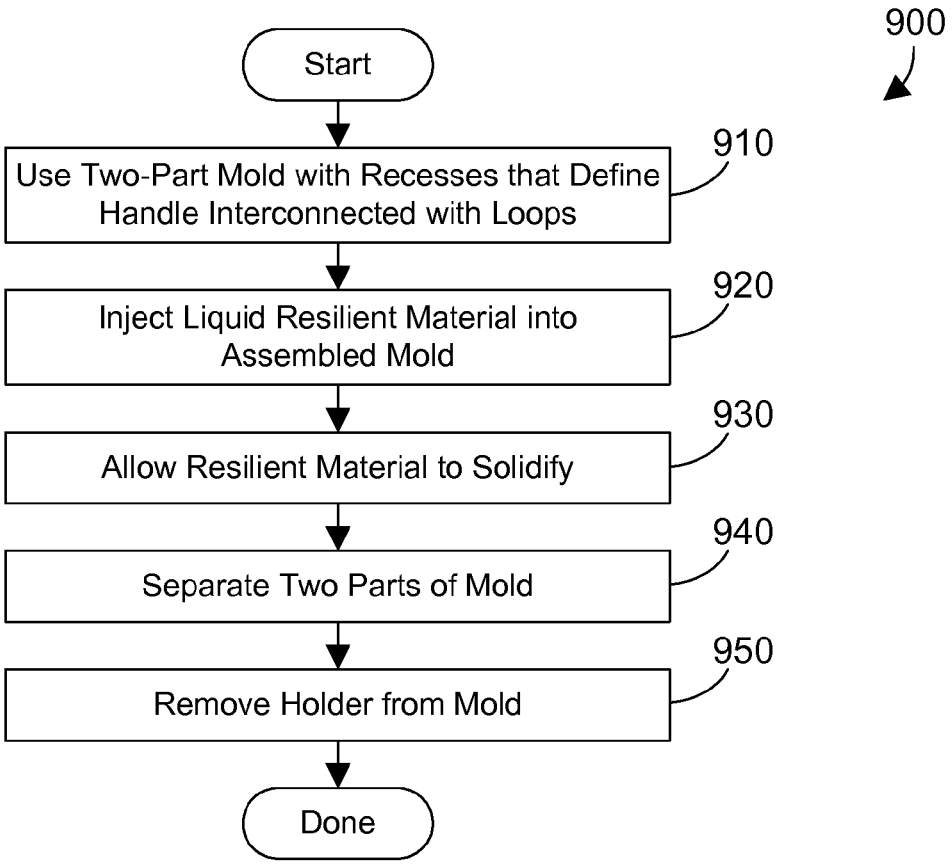
FIG. 9 is a flow diagram showing a method for manufacturing the holder for a beverage container.

Referring to FIG. 9, a method 900 shows one suitable method for making the holder 100 shown in FIGS. 1-8. A two-part mold is used that defines a first recess that defines a first loop having a first thickness, a first width and a first diameter; a second recess that defines a second loop having a second thickness, a second width and a second diameter; and a third recess communicating with the first recess and the second recess, the third recess defining a handle portion having a third thickness, a third width and a length (step 910). Liquid resilient material is then injected into the assembled two-part mold (step 920). The resilient material is then allowed to at least partially solidify (step 930). How the material is solidified depends on the type of resilient material used. For example, plastic can be injected into the mold in step 920 when in a hot, molten state, and cooling the mold results in the material in the mold solidifying. Silicone rubber can be injected into the mold in step 920, and the silicone rubber can then be cured to solidify the material, which can include heat or chemical reactants that help to cure the silicone rubber. Once the resilient material is sufficiently solidified in step 930, the two parts of the mold are separated (step 940). The holder is then removed from the mold (step 950). Because the preferred mold includes recesses that communicate with each other, injecting the resilient material into the mold results in simultaneously forming the two loops 110 and 120 and the handle 130 at the same time and of the same material such that a unitary structure is formed without joints or connectors. Of course, an alternative implementation could form the loops 110 and 120 separately, then attach handle 130 to the loops 110 and 120 using any suitable fastener, including without limitation adhesive, mechanical fasteners such as screws, snaps, rivets, etc.

The disclosure and drawings thus support a method for manufacturing a holder for a beverage container comprising the steps of using a two-part mold that defines: a first recess that defines a first loop having a first thickness, a first width and a first diameter; a second recess that defines a second loop having a second thickness, a second width and a second diameter; and a third recess communicating with the first recess and the second recess, the third recess defining a handle portion having a third thickness, a third width and a length; injecting liquid resilient material into the two-part mold until the resilient material fills the first, second and third recesses; allowing the resilient material to at least partially solidify; separating the two parts of the two-part mold; and removing the resilient material from the two-part mold, wherein the resilient material removed from the mold comprises the holder.

Figure 10:
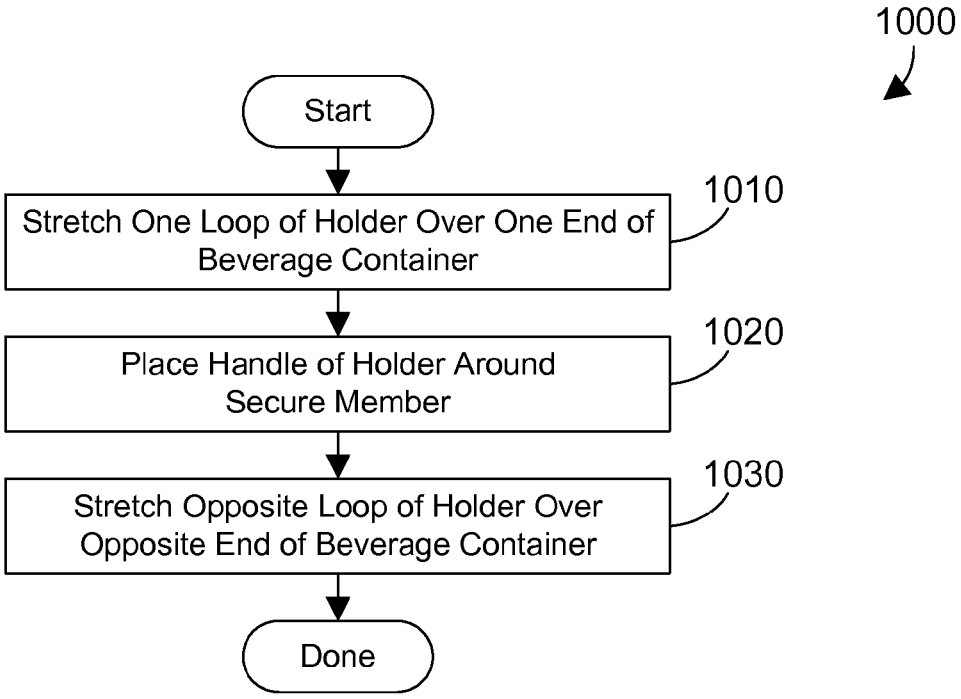
FIG. 10 is a flow diagram of a method for using the holder for a beverage container.

Referring to FIG. 10, method 1000 shows how the holder 100 in FIGS. 1-8 is used. One of the loops is stretched over one end of a beverage container (step 1010). When the user wants to secure the beverage container to something, the handle is then placed around a secure member (step 1020). The term "secure member" as used herein means anything to which a person might want to attach a beverage container. For example, the handle could be placed around the strap of a backpack, around a structural member of a bicycle, around a belt loop, etc. The opposite loop of the holder is then stretched over the opposite end of the beverage container (step 1030). When the handle was placed around a secure member in step 1020, the result is a beverage container that is now attached to something. Of course, step 1020 is optional. A person could use the holder by performing steps 1010 and 1030 without performing step 1020, which results in a beverage holder that now has a soft and comfortable handle, as shown in FIG. 1. A person can place the strap over the back of the hand with the palm facing the bottle. This is very convenient for people who walk or run, giving a comfortable way to hold a beverage container without the fatigue of a person wrapping his or her entire hand around a beverage container.

One of the benefits of using a resilient material for holder 100 is that it can stretch to accommodate a number of different sizes of water bottles. For example, in one specific configuration for use with disposable water bottles as shown in FIG. 1, the thickness T1 of the handle, T2 of the first loop and T3 of the second loop are all approximately 2 millimeters; the width W1 and W2 are approximately 14 millimeters; and diameter D1 of the first loop and diameter D2 of the second loop are both approximately 70 millimeters; the width W3 of the handle is approximately 24 millimeters; and the length L of the handle 130 is approximately 114 millimeters. The disclosure and drawings thus support an article of manufacture comprising a first loop formed of silicone rubber having a first diameter of approximately 70 millimeters; a second loop formed of silicon rubber having a second diameter of approximately 70 millimeters; and a handle formed of silicon rubber having a first end coupled to the first loop and a second end coupled to the second loop and having a length from the first end to the second end of approximately 114 millimeters. Note, however, these dimensions of holder 100 allow holder 100 to be used on much large beverage containers. For example, reusable beverage containers such as those made of rigid plastic often used by backpackers have a diameter much larger than a disposable water bottle. However, due to the resilient nature of the material used to make holder 100, the loops 110 and 120 can stretch to several times their normal size to accommodate a wide range of different sizes of beverage containers. In addition, using a resilient material such as silicone rubber produces a holder that is very rugged and can be repeatedly used for years on a wide variety of different beverage containers.

A holder for a beverage container includes first and second loops that are each coupled to opposing ends of a handle. The first and second loops are sized to be smaller than a target beverage container. The holder is attached to a the target beverage container by stretching the first loop and placing the first loop around one end of the beverage container, then stretching the second loop and placing the second loop around the opposite end of the beverage container. The holder can then be used to easily transport the beverage container, or to attach the beverage container to something, such as a bicycle or backpack. The holder is made of a rugged and durable resilient material that allows repeated use of the handle over many years.

One skilled in the art will appreciate that many variations are possible within the scope of the claims. Thus, while the disclosure is particularly shown and described above, it will be understood by those skilled in the art that these and other changes in form and details may be made therein without departing from the spirit and scope of the claims.

The invention claimed is:

1. An article of manufacture for a beverage container comprising:

a first loop formed of silicone rubber having a first diameter of approximately 70 millimeters, a substantially uniform first width of approximately 14 millimeters that contacts the beverage container when the article is placed on the beverage container, and a substantially uniform first thickness of approximately 2 millimeters;

a second loop formed of silicon rubber having a second diameter of approximately 70 millimeters, a substantially uniform second width of approximately 14 millimeters that contacts the beverage container when the article is placed on the beverage container and a substantially uniform second thickness of approximately 2 millimeters; and a handle formed of silicon rubber having a first end coupled at a non-zero angle to the first loop and a second end coupled at a non-zero angle to the second loop and having a length from the first end to the second end of approximately 114 millimeters, wherein the handle has a substantially uniform third width of approximately 24 millimeters and a substantially uniform third thickness of approximately 2 millimeters.

* * * * *